US006065653A

United States Patent [19]

Lin

[11] Patent Number: 6,065,653

[45] Date of Patent: May 23, 2000

[54] FLEXIBLE CLOTHES HANGER

[76] Inventor: Chieh-Jen Lin, P.O. Box 82-144, Taipei, Taiwan

[21] Appl. No.: 09/323,547

[22] Filed: Jun. 1, 1999

[51] Int. Cl.[7] ..... A47G 25/14

[52] U.S. Cl. ..... 223/94; 223/98

[58] Field of Search ..... 223/98, 97, 94, 223/89, 92, 85

[56] References Cited

U.S. PATENT DOCUMENTS

| | | | |
|---|---|---|---|
| 1,073,599 | 9/1913 | Gilsdorf | 223/94 |
| 2,099,308 | 11/1937 | McAllister | 223/98 |
| 3,537,625 | 11/1970 | Nuttall | 223/98 |
| 4,981,242 | 1/1991 | Grahm | 223/94 |
| 5,503,311 | 4/1996 | Chen | 223/85 |

*Primary Examiner*—Bibhu Mohanty

*Attorney, Agent, or Firm*—A & J

[57] ABSTRACT

A flexible clothes hanger that is adapted to suit clothes of different sizes, including a hanger body, two pads, two inner rods, two foamed rubber sleeves, two iron wires, and a hook. The pads of formed from PVC or rubber material and are screwably locked to either end of the hanger body. Each of the pads is provided with a central through hole. The inner rods are bendable, and the iron wires are inserted through the center of the inner rods. The foamed rubber sleeves are fitted over the inner rods. The iron wires passes through the through holes of the pads into the hanger body to secure the inner rods in the hanger body. The hook is locked to an upper end of the hanger body. The foamed rubber sleeves are non-skid structures that prevent slippage of clothes hung on the hanger. Besides, the bendability of inner rods and the iron wires is utilized to prevent alteration of shape of the clothes hung.

1 Claim, 3 Drawing Sheets

FLEXIBLE CLOTHES HANGER

BACKGROUND OF THE INVENTION (a) Field of the Invention

The present invention relates to a flexible clothes hanger that can change shape to adapt to clothes of different sizes.

(b) Description of the Prior Art

There are many types of clothes hangers available on the market. However, most of them are fixed in structure and cannot adapt to clothes of different sizes. Besides, as they are usually made of rigid material, they may damage the clothes hung thereon and clothes of smooth and slippery material may slip down. There is also available a kind of clothes hanger that includes a hanger body having two cylindrical side portions and an interior accommodating therein a spring, stop plate and an annular sleeve. The annular sleeve contains a small spring and a small annular sleeve. The smaller annular sleeve is centrally provided with an axial hole for passage and securing of an iron wire. An outer side is fitted with a cylindrical rod foam material and a distal end is provided with a wavy bent head portion. In this prior clothes hanger, the cylindrical rod foam can be extended or retracted depending on needs. Although a clothes hanger as such can adapt to clothes of different sizes, due to limitations in extension and retraction, it is not possible to form curves at the circular rod to fit the shoulders of clothes, which may deform the shape of clothes. Besides, the above-described clothes hanger is complicated to manufacture; production cost is high; and careless use may result in damage.

SUMMARY OF THE INVENTION

A primary object of the present invention is to provide a flexible clothes hanger that can adapt to clothes of different sizes.

Another object of the present invention is to provide a flexible clothes hanger that utilizes bendable inner rods to form curved portions so as to avoid damage to clothes hung thereon.

In order to achieve the above-mentioned objects, a flexible clothes hanger of the present invention includes a hanger body, two pads, two inner rods, two foamed rubber sleeves, two iron wires, and a hook. The pads of formed from PVC or rubber material and are screwably locked to either end of the hanger body. Each of the pads is provided with a central through hole. The inner rods are bendable, and the iron wires are inserted through the center of the inner rods. The foamed rubber sleeves are fitted over the inner rods. The iron wires passes through the through holes of the pads into the hanger body to secure the inner rods in the hanger body. The hook is locked to an upper end of the hanger body. The foamed rubber sleeves are non-skid structures that prevent slippage of clothes hung on the hanger. Besides, the bendability of inner rods and the iron wires is utilized to prevent alteration of shape of the clothes hung.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
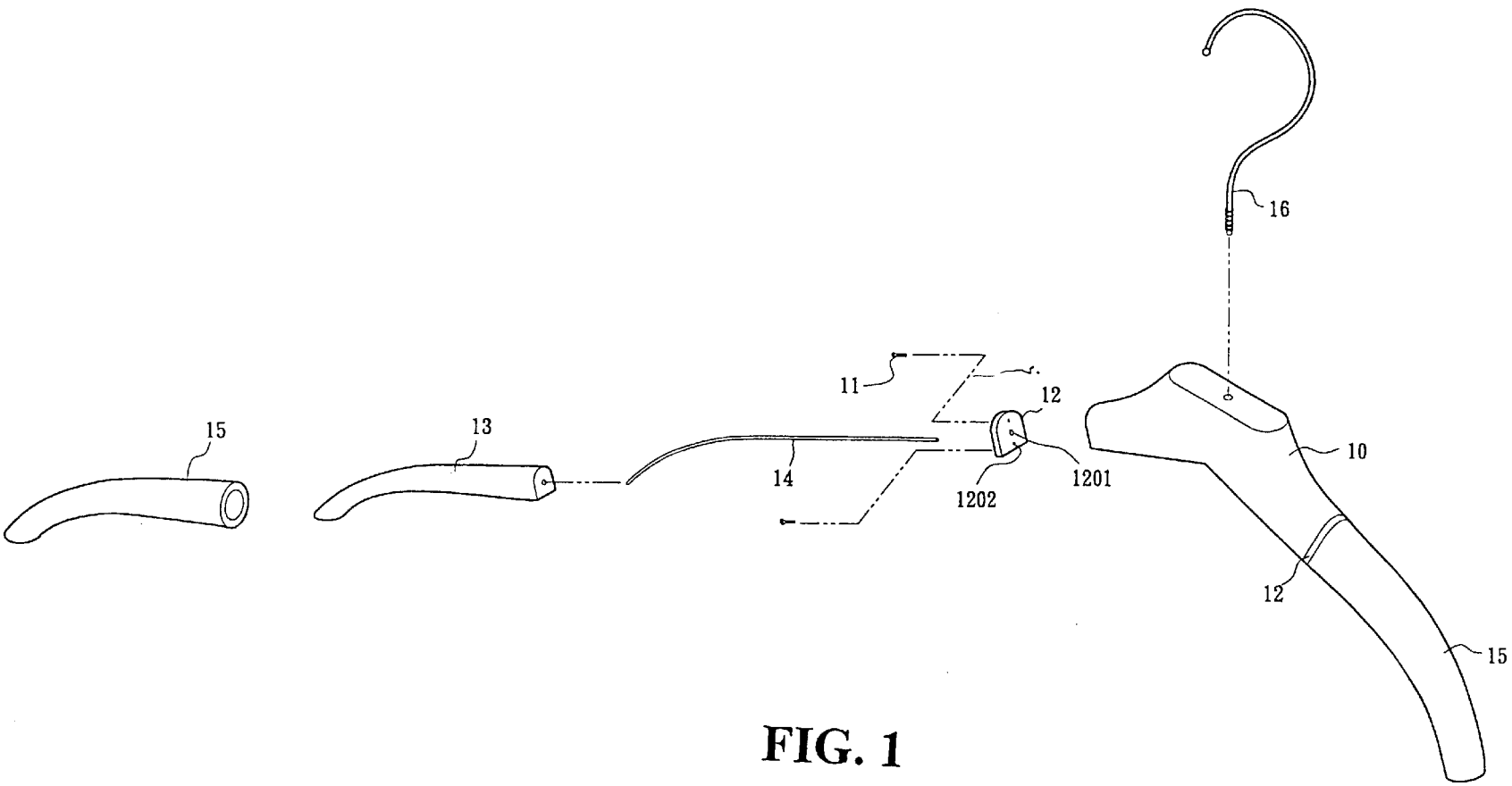
FIG. 1 is an exploded perspective view of the present invention.

With reference to FIG. 1, a preferred embodiment of a clothes hanger according to the present invention includes a hanger body 10, two pads 12 formed from PVC or rubber respectively locked to both ends of the hanger body 10 by screws 11 and centrally provided with a through hole 1201, two bendable elongated inner rods 13 each having one end face that is generally oval with the other end face forming a shape corresponding to that of the pad 12, an iron wire 14 passing through each of the inner rods 13, a foamed rubber sleeve 15 sleeved onto each of the inner rods 13, and a hook 16 locked to an upper side of the hanger body 10. The iron wire 14 passes through the corresponding through hole 1201 and is inserted into the hanger body to secure the corresponding inner rod 13 therein.

Figure 2:
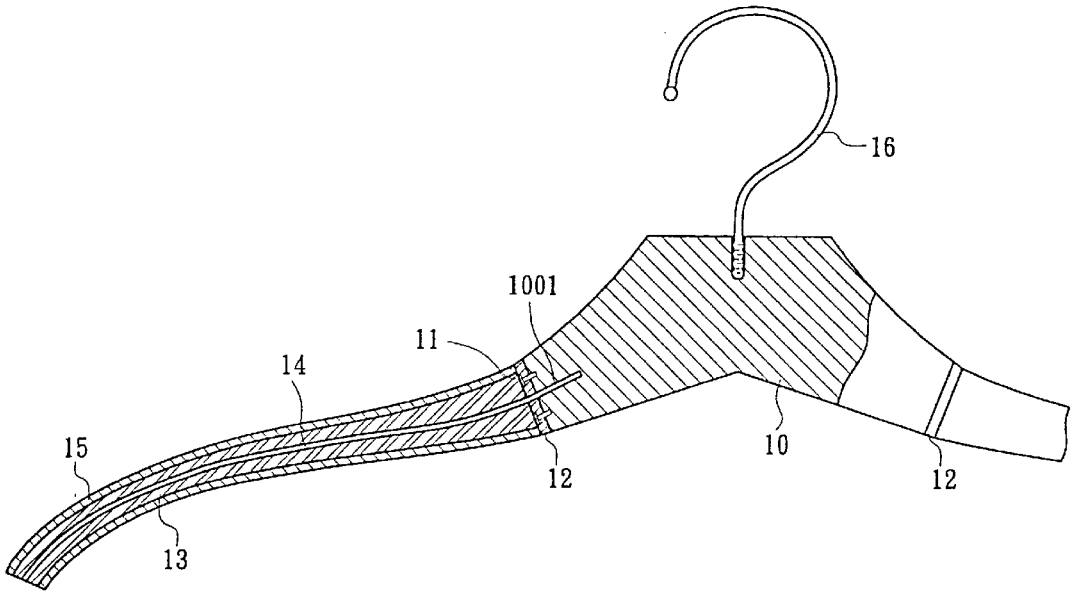
FIG. 2 is an assembled sectional view of the present invention in part.
Figure 3:
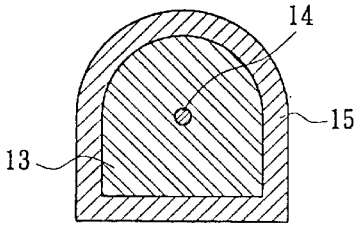
FIG. 3 is a sectional view of an inner rod and a foamed rubber sleeve according to the present invention.

With reference to FIGS. 2 and 3, the pad 12 has a generally curved upper end, and is provided with the above-mentioned through hole 1201 and two screw holes 1202 for passage of the screws 11 that lock the pad 12 to either end of the hanger body 10. The two ends of the hanger body 10 that are in contact with the pads 12 are centrally provided with insert holes 1001, respectively, that correspond to the through holes 1201. The iron wires 14 pass through the inner rods 13 and the through holes 1201 into the insert holes 1001 to be positioned. After the inner rods 13, the pads 12, and the hanger body 10 are connected and secured in position, the foam rubber sleeves 15, which are generally cylindrical, are fitted over the inner rods 13. As the foamed rubber sleeves 15 have relatively high extensibility, they can be shaped to match the inner rods 13 in tight fit.

Figure 4:
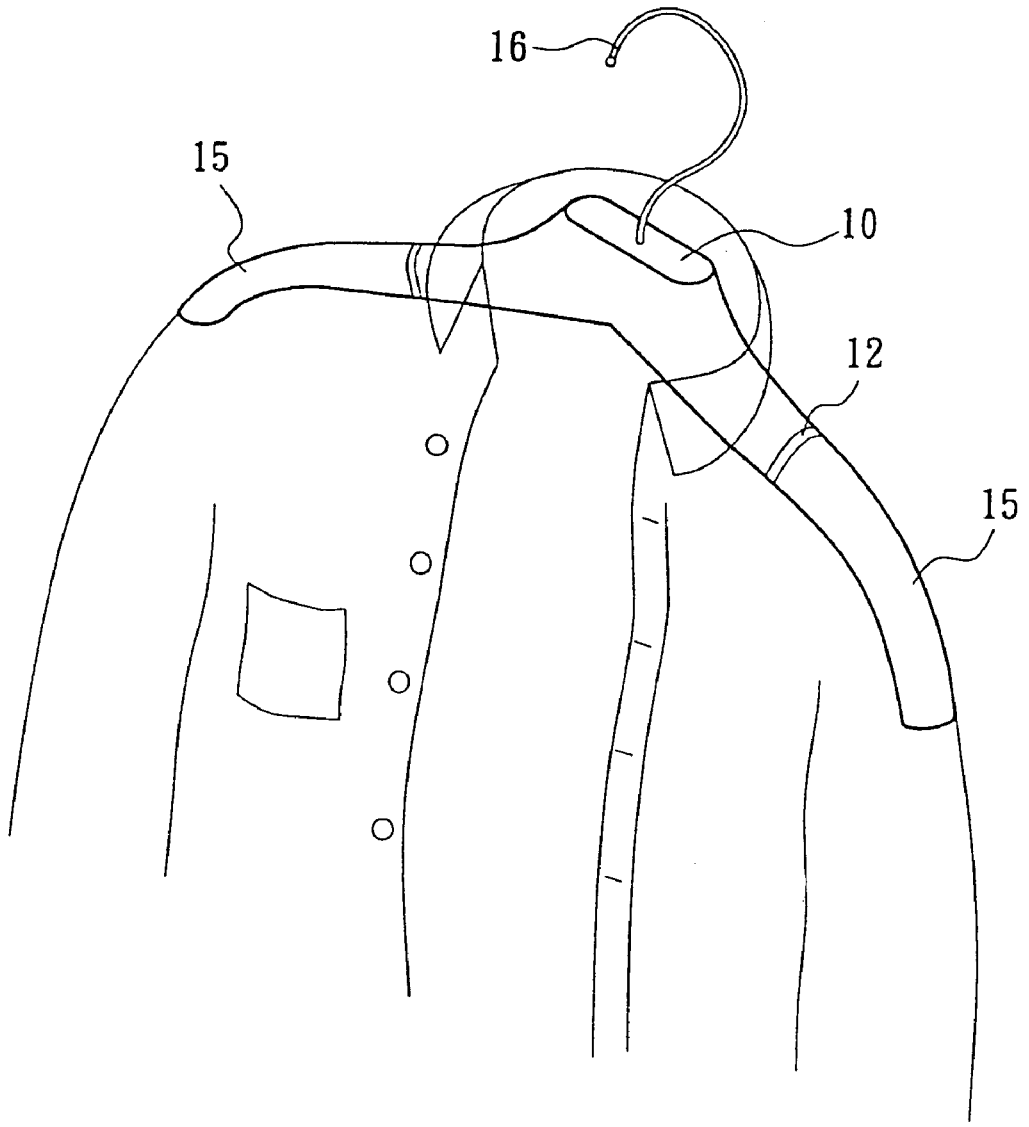
FIG. 4 is a schematic view of the present invention in use.

Referring to FIG. 4, the inner rod 13 is formed from bendable PVC material and can be bent, along with the iron wire therein, into different curvatures so that the ends thereof would not abut sharply against the shoulders of clothes to change the shape of the clothes at the shoulders. Besides, as the inner rods 13 are fitted inside the foamed rubber sleeves 15, the clothes will not change shape even after prolonged hanging. The non-skid characteristic of foamed rubber also can prevent slippage of the clothes.

It can be appreciated from the foregoing that the flexible clothes hanger of the present invention not only can adapt to different kinds of clothing to prevent damage thereto, it can also be assembled in a convenient manner.

Although the present invention has been illustrated and described with reference to the preferred embodiment thereof, it should be understood that it is in no way limited to the details of such embodiment but is capable of numerous modifications within the scope of the appended claims.

I claim:

1. A flexible clothes hanger comprising a hanger body, two pads, two inner rods, two foamed rubber sleeves, two iron wires, and a hook wherein said hanger body has two ends provided with insert holes, respectively, and a mounting hole at an upper end;

said pads are formed from PVC material or rubber and have an upper end that is generally curved, said pads being provided with a central through hole and two screw holes for passage of screws that lock said pads to said hanger body;

said inner rods are formed from bendable PVC material and have one end face forming an oval shape with the other end face forming a shape corresponding to that of said pads;

said foamed rubber sleeves are generally cylindrical and are fitted over said inner rods such that they are of the same shape as said inner rods after fitting;

said iron wires pass through center of said inner rods, each of said iron wires having a distal end passing through a respective one of said through holes of said pads to be secured in said hanger body; and said hook having a lower end provided with threads for lockably connection to said hanger body; whereby said foamed rubber sleeves have non-skid characteristics to prevent slippage of clothes hung on said flexible hanger, and said inner rods and said iron wires are bendable to enable said flexible hanger to adapt to clothes of different sizes.

* * * * *